US007702124B2

(12) United States Patent
Niederdraenk et al.

(10) Patent No.: US 7,702,124 B2
(45) Date of Patent: Apr. 20, 2010

(54) ELECTROACOUSTIC MINIATURE TRANSDUCER FOR A HEARING AID

(75) Inventors: Torsten Niederdraenk, Erlangen (DE); Joseph Sauer, Strullendorf (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1525 days.

(21) Appl. No.: 10/741,012

(22) Filed: Dec. 19, 2003

(65) Prior Publication Data

US 2004/0179709 A1 Sep. 16, 2004

(30) Foreign Application Priority Data

Dec. 20, 2002 (DE) ..... 102 60 307

(51) Int. Cl.
*H04R 25/00* (2006.01)

(52) U.S. Cl. ..... 381/426; 381/322; 381/328

(58) Field of Classification Search ..... 381/322, 381/324, 325, 328, 330, 369, 170, 174, 355, 381/426, 380, 189, 391; 181/129, 130, 135, 181/141

See application file for complete search history.

(56) References Cited

U.S. PATENT DOCUMENTS

| | | | | |
|---|---|---|---|---|
| 4,987,597 | A * | 1/1991 | Haertl | 381/325 |
| 6,512,834 | B1 * | 1/2003 | Banter et al. | 381/386 |
| 6,859,542 | B2 * | 2/2005 | Johannsen et al. | 381/174 |
| 6,932,187 | B2 * | 8/2005 | Banter et al. | 181/149 |
| 2002/0181725 | A1 | 12/2002 | Johannsen et al. | |
| 2003/0142843 | A1 * | 7/2003 | Meier | 381/322 |

FOREIGN PATENT DOCUMENTS

| | | |
|---|---|---|
| DE | 195 44 763 | 6/1997 |
| DE | 100 13 673 | 10/2001 |

* cited by examiner

*Primary Examiner*—Huyen D Le
(74) *Attorney, Agent, or Firm*—Schiff Hardin LLP

(57) ABSTRACT

The penetration of moisture and dirt often leads to a premature failure of electroacoustic miniature transducers that are used in hearing aids. A transducer membrane of a miniature transducer is provided at least in part with a hydrophobic and/or oliophobic and/or biofilm-inhibiting coating that, because its layer thickness is less than 10 μm, does not significantly influence the acoustic characteristic of the miniature transducer, and that prevents degradation of the transmission characteristic due to moisture, or moisture-caused damage to the miniature transducer. In addition, the adherence of dirt particles is prevented.

8 Claims, 1 Drawing Sheet

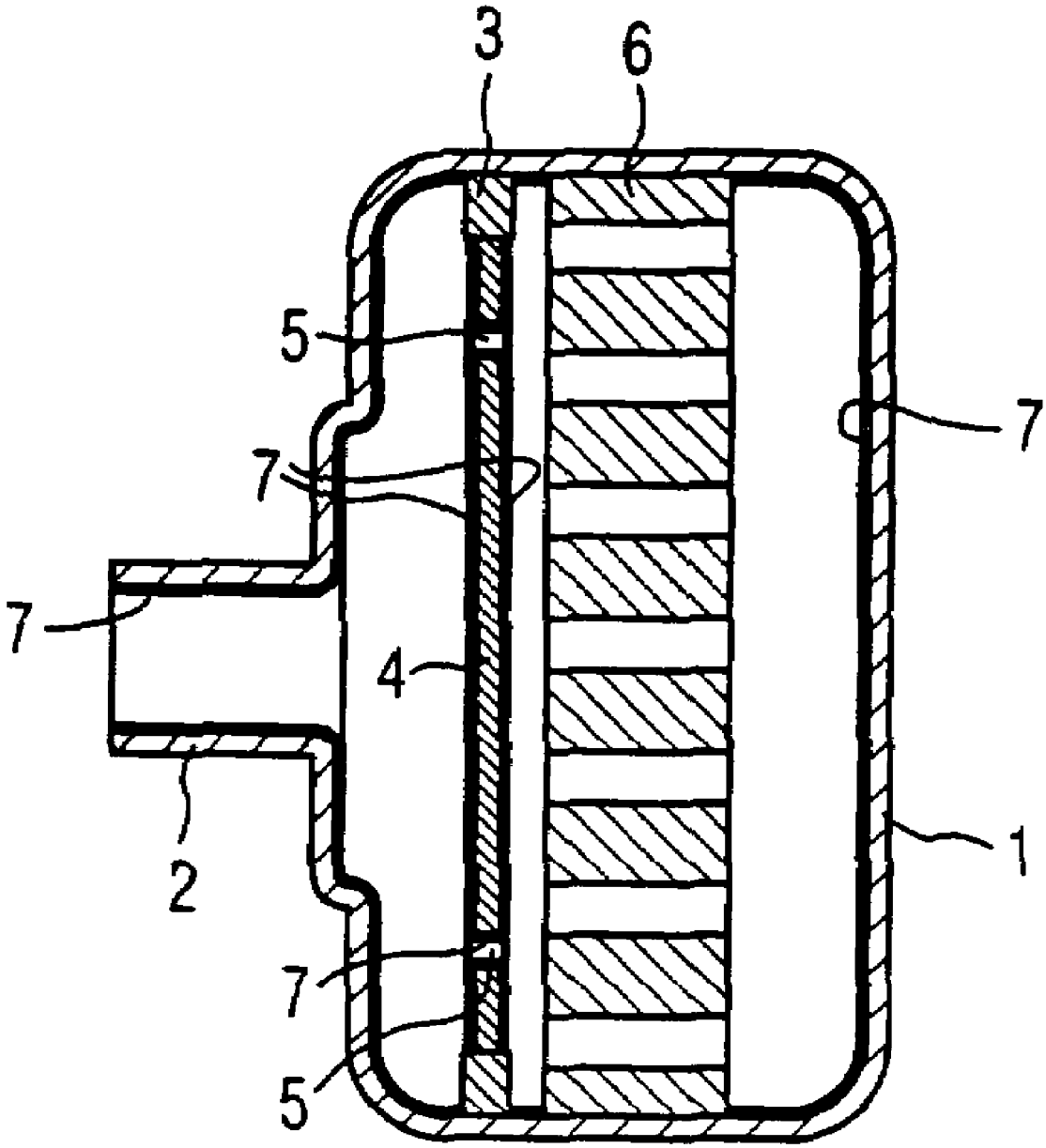
3
6
5
7
7
7
4
2
1
7
5

ELECTROACOUSTIC MINIATURE TRANSDUCER FOR A HEARING AID

BACKGROUND OF THE INVENTION

1. Field of the Invention

The present invention relates to an electroacoustic miniature transducer, having a transducer membrane, for use in a hearing aid.

2. Description of the Prior Art

In hearing aids, electroacoustic miniature transducers (microphones or earpieces) are used to convert acoustic signals into electrical signals, and to convert electrical signals into acoustic signals. For use in hearing aids, special demands are made on electroacoustic miniature transducers, in particular with respect to structural size and degree of efficiency.

From German OS 100 13 673, a micromechanical electroacoustic transducer is known that is manufactured according to the manufacturing method known from silicon semiconductor technology. The transducer has at least one supporting or carrier element, as well as a piezoelectric layer that has an electrode on its upper side and on its lower side. At least one of the electrodes extends beyond the piezoelectric layer, and is formed at least in part as an elastic membrane-and-carrier layer. In this way, a membrane-and-carrier layer having low elasticity, made of semiconductor material, is not necessary. The different layers in the known electroacoustic transducer are present due to their electrical properties (functioning as an electrode or as a piezoelectric layer) or due to their function as a carrier layer.

When used in a hearing aid, electroacoustic miniature transducers are exposed to extreme external influences. Microphones are affected above all by moisture, greases, or alcohols. In contrast, earpieces are exposed, via the auditory canal, predominantly to gaseous, liquid, or solid cerumen particles; moisture (sweat) also reaches the earpiece. In addition, dirt particles can accumulate in the sound channels of the electroacoustic miniature transducer. Together, moisture and dirt often result in a failure of the electroacoustic miniature transducer and thus of the overall hearing system.

In order to avoid contamination, electroacoustic miniature transducers, and in particular sound channels of the miniature transducers, conventionally have been partly protected using expensive coverings (screens, grids, etc.), which must be exchanged or cleaned at regular intervals. This represents a disadvantageous expense for the user.

Often, the electroacoustic miniature transducers are also used without protection, so that practice problems often occur in particular in the microphones due to the effect of air humidity, including for example loss of sensitivity or change in the transmission function due to absorption of moisture by the microphone membrane, oxidation, etc.

From the prior art, a multiplicity of surface coatings are known that can have the effect of repelling dirt, moisture, or oil. Thus, for example, from German OS 195 44 763 the use of a coating composition is known that contains polycondensates based on one or more compounds, capable of hydrolytic polycondensation, of the M elements of main groups III to V and subgroups II to IV of the periodic table. In these polycondensates, at least one organic group G, has at least two aliphatic carbon atoms, to each of which is bound at least one fluorine atom. The aliphatic carbon atoms are respectively bound, either directly via one of the carbon atoms or via a compound group A, to at least a part of central atoms M, for coating surfaces made of metal, plastics, natural materials (modified as necessary), ceramics, concrete, clay, and/or glass.

Surface coatings also are known that have a bactericidal or fungicidal effect. This effect, for example, can be based on silver ions contained in the coating, that diffuse on the surface of the layer. Such coatings are used for the sterilization of medical instruments, for example.

From United States Application Publication No. 2002/0181725, a condenser microphone is known in which the membrane is provided with a hydrophobic layer, in order to prevent the membrane from adhering to the condenser plate at the rear side of the microphone. Here, the distance between the membrane and the rear condenser plate is less than 10 μm.

SUMMARY OF THE INVENTION

An object of the present invention is to prevent the adherence of dirt particles inside an electroacoustic miniature transducer used in a hearing aid.

This object is achieved in accordance with the invention by an electroacoustic miniature transducer having a transducer membrane for use in a hearing aid, the transducer membrane being provided with an oliophobic and/or biofilm-inhibiting coating having a thickness of less than 10 μm.

This object also is achieved in accordance with the invention by an electroacoustic miniature transducer having a housing provided at least in part with an oliophobic and/or biofilm-inhibiting coating. This object also is achieved in accordance with the invention by an electroacoustic miniature transducer having at least one sound channel that is provided at least in part with an oliophobic and/or biofilm-inhibiting coating.

Standardly, an electroacoustic miniature transducer for a hearing aid includes a housing, a transducer membrane that is excited to vibrate, and that effects a conversion between an acoustic signal and an electrical signal, and a sound channel for guiding sound between the interior of the housing and the outer space surrounding the housing. Instead of a sound channel, only an opening in the housing may be present. Miniature transducers can be manufactured primarily using manufacturing processes known from silicon semiconductor technology. As a rule, these miniature transducers are relatively insensitive to moisture, because both the initial material (silicon compounds) and the coatings required for the functioning of such miniature transducers, e.g., metallizations for the formation of the electrodes, are not sensitive to moisture. Such miniature transducers, however, have acoustic disadvantages due to the high degree of rigidity of the transducer membranes. An advantage of the present invention thus is to allow the use of miniature transducers that are not manufactured in semiconductor technology, which as a rule have a much more moisture-sensitive transducer membrane made of plastic material, e.g. Mylar®.

Due to the small layer thickness of the coating, which is preferably in the nanometer range, a sufficient elasticity of the coating is ensured. This fact, and the slight additional mass represented by the extremely thin coating on the transducer membrane, have the result that the acoustic properties of the miniature transducer according to the present invention are only slightly worse than those of a miniature transducer having an uncoated transducer membrane. However, due to the moisture- and dirt-repelling properties of the transducer membrane of an acoustic miniature transducer according to the present invention, this membrane retains its acoustic properties for years, whereas in contrast conventional miniature transducers are subject to severe aging processes.

The coating is in particular an anorganic condensate, modified with organic groups, based on a coating compound that includes a hydrolysate or pre-condensate composed of one or more hydrolysable compounds, having at least one non-hydrolysable substituent, at least a part of the organic groups of the condensate preferably having fluorine atoms. In addition, or alternatively, copper or silver colloids can be contained in the coating.

Such a plastic coating has the advantage that it can be fashioned very thinly. Standard thicknesses can be in the micrometer range during the application of the coating, and can be in the nanometer range after drying. For this reason, this coating is also called a nanocoating. In addition, the coating can be applied using standard coating methods such as immersion, spraying, or painting. After a short drying, carried out if necessary, such a layer is then standardly hardened under UV light. In the context of the present invention, the composition of the coating is selected taking into account the intended coating method, in such a way that the layer thickness in the dried state is less than 10 μm. Such a value can in particular be set by the solvent content of the coating during the application.

Because moisture and dirt have especially negative effects on the transducer membrane, the present invention provides at least a coating of the side of the membrane that is oriented towards the sound entrance opening in the housing of the miniature transducer. Advantageously, however, both sides of the transducer membrane are coated. The best possible protection from the penetration of moisture into the transducer membrane, however, is provided when the jacket surfaces of the pass-through channels in the transducer membranes, which are used for barometric pressure compensation, are also coated. At least all exposed (i.e., non-clamped) areas of the transducer membrane are thus coated, and the sensitive transducer membrane is enclosed completely by a protective layer. Thus, moisture and dirt cannot result in a swelling of the transducer membrane, which would have a very negative influence on the acoustic properties. The coating according to the present invention, however, not only prevents the penetration of moisture and oil, but also dirt particles no longer can adhere to the transducer membrane. Overall, in this way the life span of an electroacoustic miniature transducer is significantly prolonged even under extreme external influences, such as those that can occur given use in a hearing aid.

In a specific embodiment of the present invention, besides the transducer membrane also the housing, in particular the inside of the housing, and the sound channel of the miniature transducer, are coated with a coating having the cited properties. The coating results in a reduction of the surface energy, so that dirt particles can no longer settle permanently on the coated surface. Liquid or solid foreign materials are repelled in this way by the coated surfaces. In particular, in this way particles of cerumen can settle only with difficulty. If cerumen nonetheless becomes deposited on the housing, or blocks the sound channel, it can easily be shaken out due to the lack of adhesion to the surfaces. A suitable shaping of the sound channel or of the housing makes such shaking out easier.

In addition, the hydrophobic and/or oliophobic surfaces prevent a capillary effect. Moisture thus no longer is absorbed through capillaries.

In a preferred embodiment of the present invention, the coating according to the present invention also has a bactericidal and fungicidal effect, besides the hydrophobic and oliophobic effect. The humid, warm climate in the auditory canal is ideal for the growth of bacteria and fungi. Thus, in particular electroacoustic miniature transducers of hearing aids worn in the auditory canal can be affected by bacteria and fungi. Besides damage to the transducers themselves, inflammation in the wearer of the hearing aid can occur as a result. These negative effects can be avoided by the inventive coating having a bactericidal and fungicidal effect.

In order to achieve the bacterial and fungicidal properties, the coating preferably contains silver ions. These are released and diffuse on the surface of the layer, where they then have the desired effect. They kill bacteria and fungi by blocking a particular enzyme that the bacteria and fungi require for their metabolism.

DESCRIPTION OF THE DRAWINGS

The single FIGURE shows an electroacoustic miniature transducer in accordance with the invention fashioned as a hearing aid microphone.

DESCRIPTION OF THE PREFERRED EMBODIMENTS

The hearing aid microphone according to the exemplary embodiment has a housing 1 with a sound collar 2, in which a microphone membrane 4 is fastened via a peripheral mount 3 on the housing 1. The microphone membrane 4 has small bored holes 5 for barometric pressure compensation, and is clamped opposite a counter-electrode 6. In this type of miniature transducer, the sound transduction is based on the capacitive transducer principle.

According to the present invention, a thin coating 7 is applied on both sides of microphone membrane 4. The jacket surface of bored holes 5 preferably also is provided with coating 7, so that the microphone membrane is completely sheathed.

The coating in accordance with the invention has a composition in which, in the dried state of the layer, a layer thickness results that does not exceed 10 μm. Preferably, the layer thickness is in the nanometer range, for which reason coating 7 is also designated a nanocoating. In the coating of miniature transducers, it can be useful to slightly modify the coating process that is standard for nanocoatings. For example, the hardening (curing) of the coating under UV light in air improves the elastic properties in comparison with hardening in a protective gas atmosphere, as is standard for nanocoatings.

Due to the elastic properties and the low mass of coating 7, this coating does not significantly influence the acoustic properties of the miniature transducer. The coating 7 has a hydrophobic, oliophobic, bactericidal, and fungicidal effect. As a result, neither moisture nor oil can penetrate into microphone membrane 4, so that oxidation and swelling of microphone membrane 4 are prevented. In addition, dirt particles do not remain stuck on microphone membrane 4. Bacteria or fungi also cannot settle thereon. Overall, the microphone membrane 4 thus retains its original acoustic properties even under the extreme external conditions that prevail in a hearing aid.

In the hearing aid microphone according to the exemplary embodiment, besides the microphone membrane 4 the inside of the housing and the inside of sound channel 2 are provided with the coating 7. Here as well, the coating 7 has the advantages that dirt particles do not adhere thereon, and thus can easily be shaken out again if they have penetrated into the sound channel or the transducer housing. In addition, moisture that has penetrated into the hearing aid microphone does not result in damage to the microphone. Overall, in this way the life span of a hearing aid microphone is significantly extended.

By the addition of a silver compound that releases silver ions, the coating 7 also inhibits the growth of bacteria and fungi, so that the settling of damaging bacteria or fungi inside the hearing aid microphone is prevented. In this way as well, damage to the hearing aid microphone can be prevented.

Although modifications and changes may be suggested by those skilled in the art, it is the intention of the inventors to embody within the patent warranted hereon all changes and modifications as reasonably and properly come within the scope of their contribution to the art.

We claim as our invention:

1. An electroacoustic miniature transducer for use in a hearing aid, comprising:

a transducer membrane; and a coating on said transducer membrane having a layer thickness of less than 10 μm, said coating being selected from the group consisting of oliophobic coatings and biofilm-inhibiting coatings.

2. An electroacoustic miniature transducer as claimed in claim 1 wherein said transducer has oppositely disposed major faces, and wherein said coating is disposed on only one of said major faces.

3. An electroacoustic miniature transducer as claimed in claim 1 wherein said transducer membrane has oppositely disposed major faces, and wherein said coating is disposed on both of said major faces.

4. An electroacoustic miniature transducer as claimed in claim 1 wherein said transducer membrane has a plurality of exposed surfaces, and wherein said coating is disposed on all of said exposed surfaces.

5. An electroacoustic miniature transducer as claimed in claim 1 comprising a housing in which said transducer membrane is disposed, said housing having a plurality of housing surfaces and at least some of said plurality of housing surfaces being covered with said coating.

6. An electroacoustic miniature transducer as claimed in claim 5 wherein said coating on said at least some of said plurality of housing surfaces also is hydrophobic.

7. An electroacoustic miniature transducer as claimed in claim 5 wherein said housing has at least one sound channel therein, said sound channel having a sound channel surface at least partially covered with said coating.

8. An electroacoustic miniature transducer as claimed in claim 7 wherein said coating at least partially covering said sound channel surface also is hydrophobic.

* * * * *